United States Patent [19]

Nguyen et al.

[11] Patent Number: 4,817,713

[45] Date of Patent: Apr. 4, 1989

[54] STEAM INJECTION PROFILING

[75] Inventors: Tanh V. Nguyen, Fullerton, Calif.; C. Brent Davenport, Houston, Tex.; Christopher E. Stevens, Lemoore, Calif.; John C. Reis, Yorba Linda, Calif.; Ralph S. Millhone, Brea, Calif.

[73] Assignee: Chevron Research Company, San Francisco, Calif.

[21] Appl. No.: 146,770

[22] Filed: Jan. 22, 1988

Related U.S. Application Data

[63] Continuation-in-part of Ser. No. 88,465, Aug. 19, 1987, Pat. No. 4,793,414, which is a continuation of Ser. No. 935,662, Nov. 26, 1986, abandoned.

[51] Int. Cl.[4] ..... E21B 43/24; E21B 47/00

[52] U.S. Cl. ..... 166/252; 166/272; 73/155

[58] Field of Search ..... 166/250, 252, 272, 303; 73/155

[56] References Cited

U.S. PATENT DOCUMENTS

| | | | |
|---|---|---|---|
| 3,123,708 | 3/1964 | Limanek | 73/155 X |
| 3,524,502 | 8/1970 | Sloan | 166/250 |
| 4,085,798 | 4/1978 | Schweitzer et al. | 166/252 |
| 4,102,185 | 7/1978 | Dowling et al. | 73/155 |
| 4,228,855 | 10/1980 | Sustek, Jr. et al. | 166/250 |
| 4,409,825 | 10/1983 | Martin et al. | 73/155 |
| 4,501,325 | 2/1985 | Frazier et al. | 166/252 X |
| 4,581,926 | 4/1986 | Moore et al. | 73/155 |

OTHER PUBLICATIONS

D. E. Bookout et al., "Injection Profiles During Steam Injection", Paper No. 801-843 C, pp. 1-16, May 3, 1967.

T. D. Elson, "Phase Separation of Two-Phase Fluid in an Injection" Wellbore, SPE 9916, 1981.

Tinker, G. E., "Gas Injection with Radioactive Tracer to Determine Reservoir Continuity," *Journal of Petroleum Technology*, p. 1251, Nov. 1973.

Wagner, O. R. "The Use of Tracers in Diagnosing Interwell Reservoir Heterogeneities," *Journal of Petroleum Technology*, p. 1410, Nov. 1977.

Lichtenberger, G. S. "A Primer on Radioactive Tracer Injection Profiling", SPE Reprint No. 118-132, SPE, 1985.

*Primary Examiner*—George A. Suchfield

*Attorney, Agent, or Firm*—S. R. La Paglia; E. J. Keeling

[57] ABSTRACT

An improved method and apparatus for determining injection profiles in a steam injection well is disclosed. The mass flow rate of steam entering the well is measured. A well logging tool is then used to measure temperature and/or pressure profiles within the perforated zone of the well. A liquid phase tracer is then injected for a short time into the well with the steam. The well logging tool contains dual gamma ray detectors and is used to measure the transit time of the tracer slug. In the preferred embodiment, the liquid tracer is radioactive elemental iodine or sodium iodide. The procedure is repeated with a vapor phase tracer which is radioactive Krypton, Argon, or Xenon in the preferred embodiment. A vapor and liquid profile can then be calculated with simple mass balance equations. In a second approach, a spinner survey and a single tracer survey are conducted. By combining the spinner and tracer survey results, vapor and liquid rates can be determined and steam injection profiles can be calculated.

4 Claims, 4 Drawing Sheets

STEAM INJECTION PROFILING

CROSS REFERENCE TO RELATED APPLICATIONS

This ion is a continuation-in-part of application Ser. No. 88,465, filed Aug. 19, 1987, now U.S. Pat. No. 4,793,414, assigned to the assignee of this invention which is a continuation of application Ser. No. 935,662, filed Nov. 26, 1986, now abandoned, also assigned to the assignee of this invention.

FIELD OF THE INVENTION

This invention relates generally to thermally enhanced oil recovery. More specifically, this invention provides a method and apparatus for accurately developing steam injection profiles in steam injection wells.

BACKGROUND OF THE INVENTION

In the production of crude oil, it is frequently found that the crude oil is sufficiently viscous to require the injection of steam into the petroleum reservoir. Ideally, the petroleum reservoir would be completely homogeneous and the steam would enter all portions of the reservoir evenly. However, it is often found that this does not occur. Instead, steam selectively enters a small portion of the reservoir while effectively bypassing other portions of the reservoir. Eventually, "steam breakthrough" occurs and most of the steam flows directly from an injection well to a production well, bypassing a large part of the petroleum reservoir.

It is possible to overcome this problem with various remedial measures, e.g., by plugging off certain portions of the injection well. For example, see U.S. Pat. Nos. 4,470,462 and 4,501,329, assigned to the assignee of the present invention. However, to institute these remedial measures, it is necessary to determine which portions of the reservoir are selectively receiving the injected steam. This is often a difficult problem.

Various methods have been proposed for determining how injected steam is being distributed in the wellbore. Bookout ("Injection Profiles During Steam Injection", SPE Paper No. 801-43C, May 3, 1967) summarizes some of the known methods for determining steam injection profiles and is incorporated herein by reference for all purposes.

The first and most widely used of these methods is known as a "spinner survey". A tool containing a freely rotating impeller is placed in the wellbore. As steam passes the impeller, it rotates at a rate which depends on the velocity of the steam. The rotation of the impeller is translated into an electrical signal which is transmitted up the logging cable to the surface where it is recorded on a strip chart or other recording device.

As is well known to those skilled in the art, these spinners are greatly affected by the quality of the steam injected into the well, leading to unreliable results or results which cannot be interpreted in any way.

Radioactive tracer surveys are also used in many situations. With this method methyl iodide (131) has been used to trace the vapor phase. Sodium iodide has been used to trace the liquid phase. The radioactive Iodine is injected into the steam between the injection well and the steam generator. The tracer moves down the tubing with the steam until it reaches the formation, where the tracer is temporarily held on the face of the formation for several minutes. A typical gamma ray log is then run immediately following the tracer injection.

The recorded gamma ray intensity at any point in the well is then assumed to be proportional to the amount of steam injected at that point.

The vapor phase tracers have variously been described as alkyl halides (methyl iodide, methyl bromide, and ethyl bromide) or elemental iodine. Although it has previously been believed that these alkyl halide vapor tracers were not subject to decomposition in the short time periods involved, it has been noted that the above materials undergo chemical reactions that dramatically affect the accuracy of the results of the survey in steam injection profiling as described in related application Ser. No. 935,622.

SUMMARY OF THE INVENTION

A method of determining relative liquid and vapor phase steam profiles in a steam injection well is described. The method generally comprises the steps of inserting a well logging tool into a steam injection well at a first location, said logging tool further comprising a first gamma ray detector, said first location below said perforated zone and above said tubing tail; inserting a second gamma ray detector in communication with steam upstream of said first gamma ray detector, injecting an radioactive, vapor phase tracer into the steam injection well selected from the group: radioactive Argon, radioactive Krypton, and radioactive Xenon; determining a liquid transit time between said first and said second gamma ray detector; injecting an radioactive, thermally stable vapor phase tracer into the steam injection well; determining a vapor transit time between said first and said second gamma ray detector; moving said logging tool to a second location; repeating the above steps at a second location; and calculating an amount of vapor entering a formation between the first and the second locations.

DETAILED DESCRIPTION OF THE INVENTION

Figure 1:
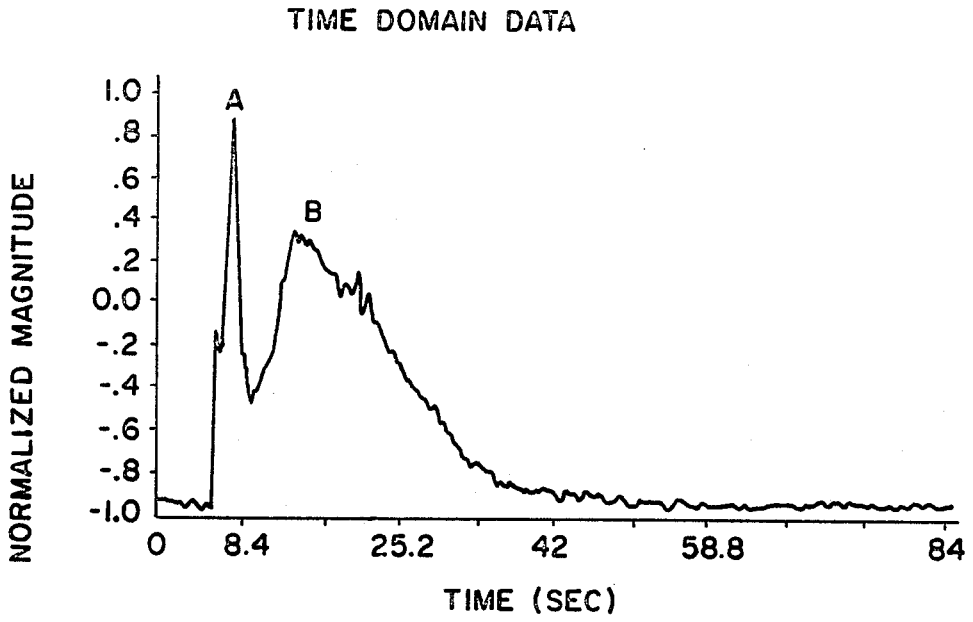
FIG. 1 plot showing the gamma ray detector outputs for a methyl iodide survey.

It has been found that up to 89 percent of the methyl iodide injected into a steam injection well hydrolyzes within 10 seconds exposure to typical injection well conditions. In a field trial, methyl iodide was injected into the well and traveled into the formation in about 10 seconds. Gamma ray detector outputs (as shown in FIG. 1) show two distinct peaks characteristic of methyl iodide in the vapor phase (peak A) and decomposition products in the liquid phase (peak B). Calculations of the area under these two curves show that 89 percent of the methyl iodide is found in the liquid. Note that peak B shows strong dispersion characteristic of a liquid signal.

Methyl iodide and other alkyl halide tracers are believed by the inventors herein to degrade according to the following reactions in a steam injection well within the time required for the tracers to reach the formation:

Methyl iodide: $CH_3I+H_2O \rightarrow CH_3OH+HI$

Ethyl iodide: $C_2H_5I+H_2O \rightarrow C_2H_5OH+HI$ (with a possible side reaction:

$C_2H_5I \rightarrow C_2H_4+HI$)

Methyl bromide: $CH_3Br+H_2O \rightarrow CH_3OH+HBr$

Ethyl bromide: $C_2H_5Br+H_2O \rightarrow C_2H_5OH+HBr$

Due to the high solubility and low vapor pressure of HI and HBr, the reaction products will virtually totally equilibrate into the liquid phase of the steam. Also, HI and HBr are strong acids while the liquid phase of the steam is very basic, so once the HI or HBr equilibrates into the liquid phase, they will be converted to salts which are totally water-soluble. Therefore, when a portion of an alkyl halide vapor phase tracer thermally degrades (hydrolyzes) within the wellbore, the liquid phase of the steam will also be traced. When all of the vapor phase tracer has hydrolyzed, virtually only the liquid phase will be traced. These problems make it virtually impossible to formulate an accurate injection profile.

Figure 2:
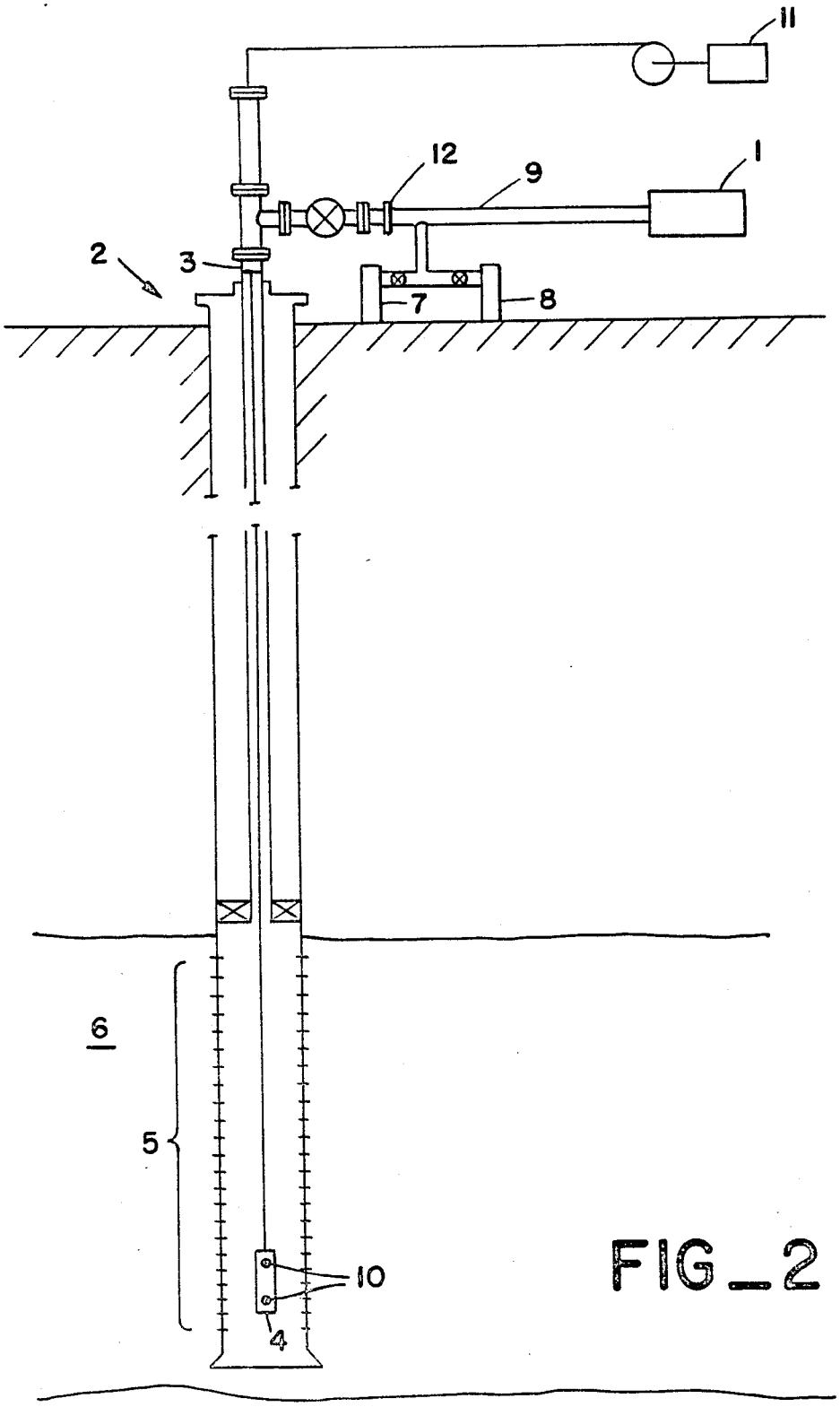
FIG. 2 schematically illustrates the method and apparatus used in determing profiles on perforated zones below the tubing tail.

Therefore, an improved method and means of determining the steam injection profile of a steam injection well has been devised. FIG. 2 schematically illustrates the method and apparatus used when the tubing tail is above the perforated zone. Steam is generated in steam generator 1 and injected into steam injection well 2 through tubing 3 and perforations 5 into petroleum formation 6. It is important in the practice of the present invention that the steam rate and quality be maintained at a relatively constant level, so conditions should be stabilized before the method is carried out. The steam mass flow rate (and, optionally, quality) is determined at the wellhead with measurement equipment 12.

Initially, a well logging tool 4 is used to develop temperature and/or pressure profiles which enable the determination of vapor and liquid densities from steam tables. Well logging tool 4 is then returned to the bottom of perforated zone 5. Vapor phase profiles are preferably performed first, although it is possible to perform liquid phase profiles first. If liquid phase profiles are performed first, the wellbore may remain somewhat radioactive and mask vapor phase results. Liquid phase profiles are discussed first below for purposes of illustration. A slug of liquid phase tracer 7 is then injected into steam line 9. In the preferred embodiment, liquid phase tracer 7 is elemental iodine 131 or sodium iodide. A sufficient quantity is injected to permit easy detection at the gamma ray detectors. This quantity will vary radically depending on the steam flow rate and steam quality, but can readily be calculated by one skilled in the art.

Logging tool 4 is of a type well known in the art and contains gamma ray detectors 10. Instrumentation and recording equipment 11 is used to record the transit time for the passing slug of tracer between the detectors 10. Logging tool 4 is then moved upward in the wellbore and the above procedure is repeated.

After data have been gathered using the liquid phase tracer 7, logging tool 4 is returned to the bottom of the perforated zone and the above procedure is repeated using thermally stable vapor phase tracer 8. In the preferred embodiment, vapor phase tracer 8 is Krypton 85, Argon, Xenon 133, or other radioactive, thermally stable gases. Unlike previously used tracers, these tracers have no charge and, therefore, no affinity for the formation. The "plating out" technique would therefore not be useful.

The vapor and liquid flow rates at each location in the perforated zone can now be determined respectively with the equations:

$$V_V = L/T_V \tag{1}$$

$$V_L = L/T_L \tag{2}$$

where:

$V_V$=Vapor velocity;

$V_L$=Liquid velocity;

L=The distance between detectors 10;

$T_V$=Vapor transit time; and $T_L$=Liquid transit time.

From a simple mass balance, it is also found that:

$$W = [\rho_V \alpha V_V + \rho_L(1-\alpha)V_L]A \tag{3}$$

where:

W=The mass flow rate measured at each tool location;

A=The wellbore cross-sectional area corrected for the presence of the logging tool;

$\rho_V$ and $\rho_L$=The vapor and liquid phase densities (determined from the temperature logs, the pressure logs, or from both); and $\alpha$=The downhole void fraction.

Solving for $\alpha$ from Equation (3) yields:

$$\alpha = \frac{\frac{W}{A} - \rho_L V_L}{\rho_V V_V - \rho_L V_L} \tag{4}$$

The downhole steam quality above the top perforated zone, i.e., at the tubing tail, can then be calculated from the equation:

$$x = \frac{\rho_V \alpha V_V}{\rho_V \alpha V_V + \rho_L(1-\alpha)V_L} \tag{5}$$

where: x=Steam quality at the top of the perforated zone.

Beginning at the top of the perforations, the vapor and liquid profiles can now be determined. Since the total mass flow rate into the well is known, the vapor and liquid flow rates at the top of the perforated interval (designated station "1") can be calculated from the equations:

$$W_{V1} = (W)(x) \tag{6}$$

$$W_{L1} = (W)(1-x) \tag{7}$$

where:

$W_{V1}$=The vapor mass flow rate at station 1.

$W_{L2}$=The liquid mass flow rate at station 1.

The amount of vapor and liquid leaving the wellbore between station 1 and station 2 is now given by the equations:

$$W_{WV1} = W_{V1}\, 1 - \frac{\alpha_2}{\alpha_1} \cdot \frac{T_{V1}}{T_{V2}} \quad (8)$$

$$W_{WL1} = W_{L1}\, 1 - \frac{(1-\alpha_2)}{(1-\alpha_1)} \cdot \frac{T_{L1}}{T_{L2}} \quad (9)$$

The vapor and liquid mass flow rates at station 2 are now given by the equations:

$$W_{V2} = W_{V1} - W_{WV1}$$

$$W_{L2} = W_{L1} - W_{WL1}$$

The above calculations can now be performed at every location in the wellbore where data have been taken. In general, the amount of vapor and liquid entering the formation between station i and station (i+1) will be given by the equations:

$$W_{WVi} = W_{Vi}\left[1 - \left(\frac{\alpha_{i+1}}{\alpha_i}\right)\left(\frac{T_{Vi}}{T_{V(i+1)}}\right)\right] \quad (10)$$

$$W_{WLi} = W_{Li}\left[1 - \left(\frac{(1-\alpha_{(i+1)})}{(1-\alpha_i)}\right)\left(\frac{T_{Li}}{T_{L(i+1)}}\right)\right] \quad (11)$$

As an alternative to the above procedure, a single tracer can be used (for either the vapor or liquid phase, as described above) in combination with a spinner survey of the type well known to one skilled in the art. As a second alternative, the vapor phase profiles discussed above can be used in conjunction with liquid phase "plating out" techniques. The spinner can be used to extract the total mass flow rate at any given point within the perforated zone. Simple mass balance equations can then be used to develop a profile along the perforated zone. In this approach, the spinner response is represented by the following equations:

$$rps = f(W_V, W_L, X) \quad (12)$$

where:

rps = the spinner response
$W_V$ = the vapor flow rate
$W_L$ = the liquid flow rate
X = the steam quality The tracer survey results are used to calculate the flow rate of one phase ($W_V$ or $W_L$). Equation (12) is then used to calculate the other flow rate ($W_L$ or $W_V$). The above-described vapor or liquid tracers are used.

The above-described method is useful when the perforated interval(s) lie below the tubing tail. However, it is necessary to make adjustments to the method when the perforated interval(s) are above the tubing tail 22 as shown in FIG. 3.

Figure 3:
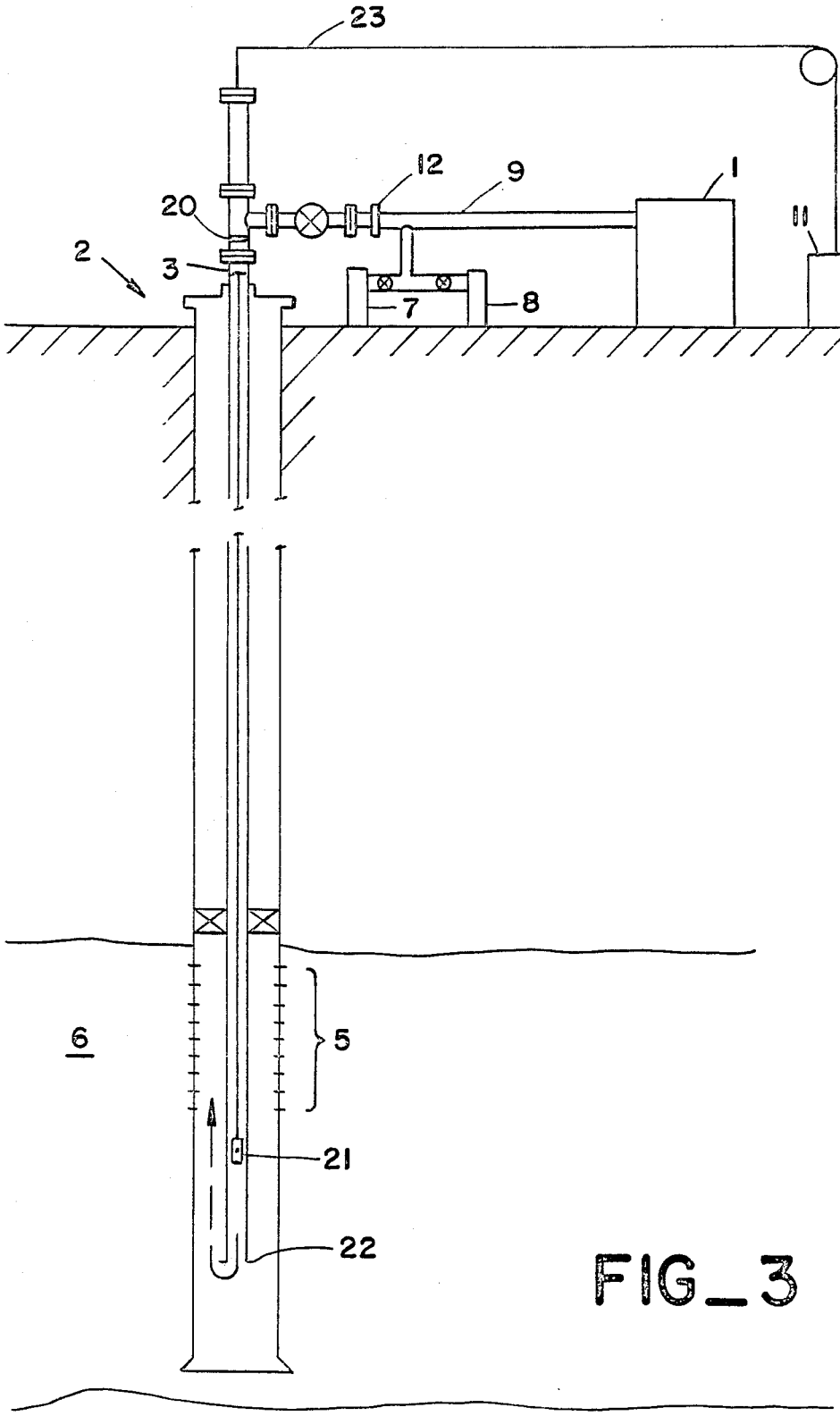
FIG. 3 schematically illustrates a method of performing profiles with the tubing tail below the perforated zone.

Referring to FIG. 3, perform steam injection profiles above the tubing tail, a temperature and/or pressure profiles are optionally run and a single gamma ray detector 20 is placed substantially near the surface. A second single gamma ray detector 21 is lowered into the tubing 3 with wireline 23 to an area above the tubing tail and, preferably, near the tubing tail. A slug of liquid phase tracer is injected into the steam and $\Delta t_{1L}$ is measured, i.e., the amount of time needed for the liquid slug to go from the surface gamma ray detector 20 to the downhole detector 21. In addition, $\Delta t_{2L}$ is measured, i.e., the time needed for the liquid slug to pass from the downhole detector 21 through the tubing to the tubing tail, and back up the annulus to pass the downhole gamma detector a second time. When measuring $\Delta t_{2L}$, the tool should be preferably, below the perforated zone. As before, this process is repeated with a slug of thermally stable vapor phase tracer, the tool is raised, and the process is repeated. It is now possible to develop a steam injection profile as follows. It should be noted that liquid velocities and, therefore, profiles are likely to be more difficult to obtain in the annular space by this method, although vapor profiles should be accurate. It may be desirable, therefore, to use the known "plating out" techniques to develop the liquid phase profiles in conjunction with the improved method of developing vapor profiles described herein. For purposes of illustration below, it is assumed that the liquid profile is also obtained with velocity profiles. Liquid profiles can be readily calculated from the injection profiles obtained from the "plating out" technique and the equations described herein.

The velocity of the liquid in the tubing ($V_{TL}$) and the velocity of the vapor in the tubing ($V_{TV}$) are determined with the following equations:

$$V_{TL} = h_T/\Delta t_{TL} \quad (13)$$

$$V_{TV} = h_T/\Delta t_{TV} \quad (14)$$

where $h_T$ = the distance from the surface gamma ray tool to the downhole gamma ray tool;
$\Delta t_T$ = elapsed time from the slug passing the surface gamma ray tool to the time it passes the downhole tool (subscript L = liquid and V = vapor);
$V_T$ = velocity in the tubing.

Note that in some situations the pressure and temperature of the steam along the tubing may vary sufficiently that the velocity will vary over the length of the tubing. In that case, the velocity can readily be calculated along differential sections of tubing, or one could, preferably, locate the detector at various locations along the tubing to determine tubing velocity at various points.

The velocity of the liquid and vapor are now determined in the annulus ($V_A$) with the equations:

$$V_{AL} = \frac{h_A}{\left[\Delta t_{2L} - h_A\left(\frac{1}{V_{TL}}\right)\right]} \quad (15)$$

$$V_{AV} = \frac{h_A}{\left[\Delta t_{2V} - h_A\left(\frac{1}{V_{TV}}\right)\right]} \quad (16)$$

wherein $h_A$ = the distance from the downhole gamma ray tool to the tubing tail;
$\Delta t_2$ = the elapsed time from the slug passing the downhole tool at the first station on the downward pass until it passes the tool on the upward pass.

The annular void fraction at station 1 ($\alpha_{A1}$) is now calculated from the equation:

$$\alpha_{A1} = \frac{\frac{W}{A_A} - \rho_L V_{AL}}{\rho_V V_{AV} - \rho_L V_{AL}} \quad (17)$$

where: $A_A$=Cross-sectional area of the annulus and the steam quality at the first station in the annulus is calculated from the equation:

$$x_{A1} = \frac{\rho_V \alpha_{A1} V_{AV}}{\rho_V \alpha_{A1} V_{AV} + \rho_L (1 - \alpha_{A1}) V_{AL}} \quad (18)$$

The mass flow rate of liquid and vapor at station 1 can be calculated from the equations:

$$W_{V1} = W(X_{A1}) \quad (19)$$

$$W_{L1} = W(1 - X_{A1}) \quad (20)$$

The tool is moved to a higher location and the above process is repeated. In general, the annular velocity for either the liquid or vapor phase at a station "i" is given by the equation:

$$V_{Ai} = \frac{h_i - h_{(i-1)}}{\Delta_{ti} - \sum_{n=1}^{i} \left( \frac{h_n - h_{(n-1)}}{V_{ti}} \right) - \sum_{n=1}^{i-1} \left( \frac{h_n - h_{(n-1)}}{V_{an}} \right)} \quad (21)$$

where:

$h_i$=detector depth measured from same reference point $V_{Ai}$=average annular velocity between $h_i$ and $h_{i-1}$ $\Delta_{ti}$=the time between two pulses observed at the detector $V_{ti}$=tubing velocity at depth $h_i$.

The above equation can then readily be substituted into equations (17) and (18) to obtain x at any station. The amount of vapor and liquid entering the formation between stations i and (i+1) are then given from the equations:

$$W_{WVi} = W_{vi} - W_{v(i+1)} \quad (22)$$

$$W_{WLi} = W_{Li} - W_{L(i+1)} \quad (23)$$

Figure 5:
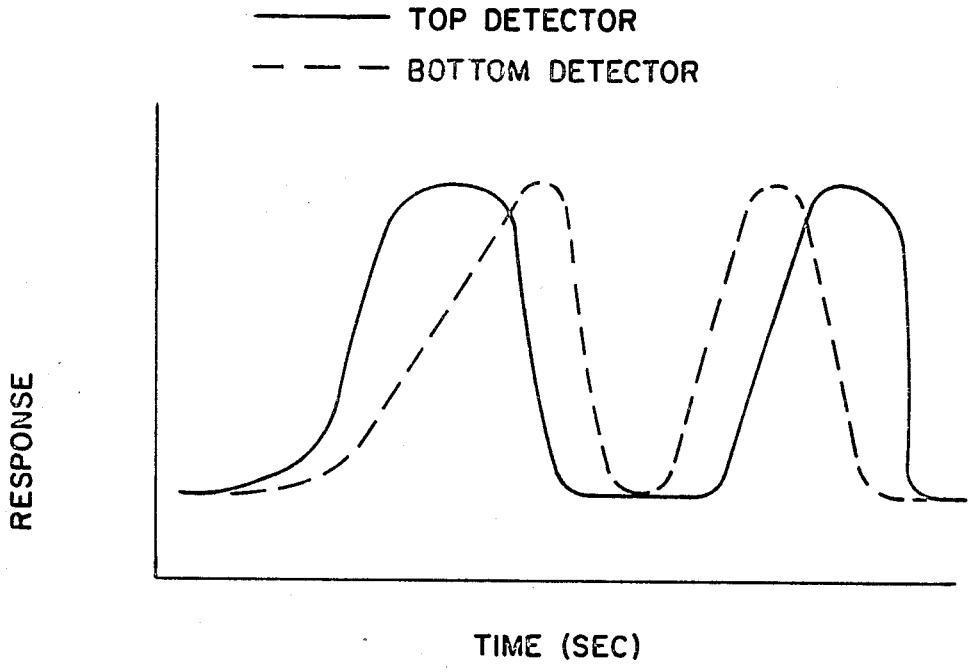
FIG. 5 shows a conceptual response curve for the embodiment s in FIG. 4.
Figure 4:
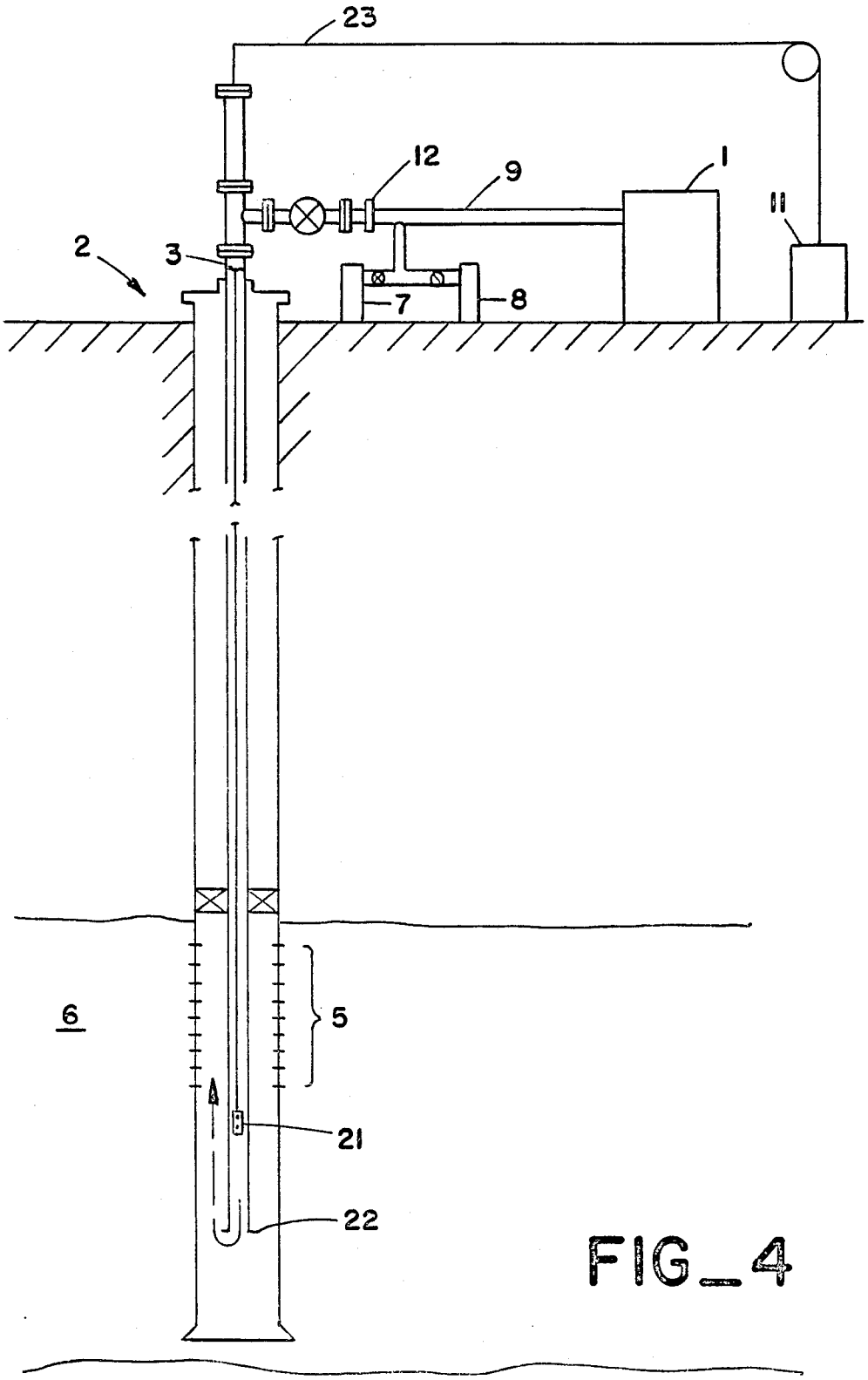
FIG. 4 schematically illustrates a second method of performing pro the tubing tail below the perforated zone.

In a preferred embodiment the steam profiles in a perforated zone above a tubing string with a dual gamma ray logging tool, as illustrated in FIG. 4. A dual gamma ray logging tool would produce an response curve similar to that shown in FIG. 5.

The steam profile can be determined in the same manner as described above in the first embodiment, i.e.:

1. The mass flow rate into the well is determined.
2. Temperature and/or pressure logs are run.
3. Liquid and thermally stable gas phase tracers are used to determine transit times. In this case, the relevant transit time will be the time from the time the slug passes the lower detector until it passes the upper detector while passing the tool in the annulus. Alternatively, a single detector can be used and the relevant transit time will be from the time the slug passes the detector in the tubing until the time it passes the detector in the annulus. This procedure is repeated at the bottom of the perforated interval and along the perforated interval.
4. Profiles are determined using the mass flow rate of steam, the vapor transit times in the annulus, and the annulus cross-sectional area.

It should be noted in all of the above embodiments that it is not critical to know the exact mass flow rate of steam entering the well. If the mass flow rate into the well is not known, a significant amount of information can be derived simply by knowing the relative amounts of the two phases of steam entering the formation at various locations. Furthermore, it would be possible to determine the steam injection profile by using a thermally stable vapor phase tracer to develop velocity profiles, and use the previously mentioned methods for determining liquid profiles, for example, to measure gamma ray intensity along the wellbore when it is held on the formation wall.

The invention described herein can be useful in applications beyond those discussed above. Fore example, the invention could find application when the tubing tail is within the perforations. This configuration would require that 100% flow be measured in the tubing. To calculate profile, all measured transit times are converted to equivalent transit times in a common flow area, such as casing. Profile calculations would otherwise be identical to that described above.

Downhole steam quality is a useful parameter and can also be determined from the above-described method for determining a total heat injection profile and overall heat loss. The wellhead steam flow rate, downhole pressure and vapor velocity are used to calculate downhole quality. Steam quality and flow rate are given by, for example, Equations 3 and 5. Even when liquid velocities are not available, void fraction and multiphase flow correlations can be used to determine quality.

Given the vapor and liquid phase profiles, downhole pressure, downhole quality, and total flow rate into the well, a total heat profile can also be calculated. The downhole quality and vapor phase profile can be obtained with an inert gas survey. The liquid phase profile can be obtained with a conventional sodium iodide survey. The fraction of heat entering each zone of interest is given by:

$$F + \frac{GH_v x + LH_l(1 - x)}{H_v x + H_l(1 - x)} \quad (24)$$

where:

F=Fraction of heat entering an interval

G=Fraction of vapor entering an interval $H_v$=Enthalpy of the vapor x=Quality at the interval L=Fraction of liquid entering an interval $H_l$=Enthalpy of the liquid.

To test the above-described methods, certain field trials have been run. They are described below:

1. WELL 1-7B

Well 1-7B is a steam injector in a steamdrive project located in Coalinga, Calif. The well is completed with four 0.25 in. JHPF over three perforated intervals. The tubing tail is set within the bottom set of perforations and the steam packer is set 5 feet above the top perforation. A vapor phase survey was run using krypton and a conventional liquid phase survey was run using sodium iodide.

Because the tubing tail is within the bottom set of perforations, 100% flow transit time was measured in the tubing. Surface-to-tool travel times in the tubing were used to determine the 100% flow transit time in the annulus. Using surface-to-tool transit times from Stops 1 and 3, the 100% flow transit time in the annulus was determined to be 0.83 seconds. Stops 2 and 3 yielded annular transit times of 1.7 seconds and 1.1 seconds, respectively. The percentage of total vapor flow going by Stops 2 and 3 is 49% and 75%, respectively. This yields a vapor phase profile of 49% out the top set of perforations, 26% out the middle set, and 25% out the bottom set of perforations. The liquid phase profile showed almost all the liquid exiting the bottom set of perforations with a trace of liquid existing the middle set of perforations. These surveys show that high degree of phase segregation can occur in steam injection wells. The average downhole quality between Stops 1 and 3 is calculated to be 37%.

2. WELL 8-2W

Well 8-2W is a steam injector in a steamdrive project located in the Midway-Sunset field of Taft, Calif. The well was completed with eight 0.25-in limited entry perforations over a 200-foot injection interval. The well has 2⅜-in. tubing from surface to 866 feet with a steam packer set at 860 feet. Shortly after perforating, the perforations were broken down with produced water to a stabilized pressure at the same injection rate for each perforation. Because the first, second and seventh perforations had the lowest breakdown pressure, it was expected that these perforations would take most of the injected steam. The eighth perforation is considered ineffective due to the high-breakdown pressure.

The results of the conventional sodium and methyl iodide did not agree with the breakdown record showing less than expected water and gas exiting the first, second, and seventh perforations with a total of 21% of the liquid and 14% of gas exiting these perforations. In addition, the sodium iodide and methyl iodide surveys yielded very similar results (within the accuracy of the plating-out technique). A krypton survey was run six days after the conventional survey. The krypton survey showed 84% of the total vapor exiting the first, second, and seventh perforations. These results yielded a better match with the breakdown record. With a surface pressure of 630 psi and a travel time from surface to tubing tail of 9.4 seconds, it was apparent that virtually all the methyl iodide had entered the water phase by the time the tracer reached the tubing tail. The sodium iodide and methyl iodide surveys were similar because they were both tracing the water phase. In this example, using methyl iodide, yielded a very misrepresentative vapor phase profile.

3. WELL 4-2B

Well 4-2B is a steam injector in a steamdrive located in Coalinga, Calif. The well is completed with four 0.25-in. JHPF over five perforated intervals. A 2⅞-in. tubing string runs from surface to 831 feet with a steam packer set at 831 feet. A steam injection survey using krypton was run to determine the percentage of vapor exiting each set of perforations. A conventional methyl iodide survey was run directly after the krypton survey. The krypton survey showed all the vapor exiting the top two sets of perforations. No krypton passed below 858 feet indicating that a fluid level must be present above 858 feet. The methyl iodide survey, however, showed the bulk of the tracer below the fluid level. This example points to severe error which can occur from using alkyl halides to trace the vapor phase of steam.

4. WELL 22-10

Well 22-10 is a steam injector in a steamdrive located in Kern River, Calif. Vapor velocity, liquid velocity, and pressure were measured at the tubing tail under the following injection conditions:

Injection rate: 460 BD
Surface quality: 55%
Tubing size: 2 in.
Casing size: 5.5 in.
Tubing length: 550 ft.

Calculations yielded downhole steam qualities of 48% and 50%, respectively. These values are comparable to a steam quality of 52% obtained from a standard wellbore heat loss calculation.

It is to be understood that the above-described embodiments are intended to be illustrative and not restrictive. For example, the order of the above-described steps could readily be varied. For that reason, the scope of the invention is not to be limited by the above-described embodiments, but instead by the appended claims along with the full range of equivalents thereto.

What is claimed is:

1. A method of determining steam profiles in a steam injection well comprising the steps of:

(a) inserting a well logging tool into a steam injection well at a first location, said logging tool further comprising a first gamma ray detector, said first location above said tubing tail;

(b) inserting a second gamma ray detector in communication with said steam upstream of said first gamma ray detector;

(c) injecting a radioactive, thermally stable tracer into the steam injection well, said tracer selected from the group: radioactive Argon, radioactive Krypton, and radioactive Xenon;

(d) determining a transit time between said first and said second gamma ray detector;

(e) moving said logging tool to a second location;

(f) repeating steps (c) and (d); and (g) calculating, by use of said transit time, an amount of fluid entering a formation between said first location and said second location.

2. A method of determining relative liquid and vapor steam injection profiles in a steam injection well having an annulus and a perforated zone above a tubing tail comprising the steps of:

(a) inserting a well logging tool into said injection well at a first location, said logging tool further comprising dual gamma ray detectors, said first location being below said perforated zone and above said tubing tail;

(b) injecting a radioactive, liquid phase tracer into said steam injection well;

(c) determining a liquid transit time in said annulus with said logging tool;

(d) injecting a radioactive, thermally stable vapor phase tracer into the steam injection well, said vapor phase tracer selected from the group: radioactive Krypton, radioactive Argon, and radioactive Xenon;

(e) determining a vapor transit time in said annulus with said logging tool;

(f) moving said logging tool to a second location;

(g) repeating steps (b), (c), (d) and (e); and (h) calculating, by use of said transit time, an amount of vapor and an amount of liquid entering a formation between said first location and said second location.

3. A method of determining vapor phase profiles in steam injection well having an annulus and a perforated zone above a tubing tail comprising the steps of:

(a) inserting a well logging tool into said injection well at a first location, said logging tool further comprising dual gamma ray detectors, said first location below said perforated zone and above said tubing tail;

(b) injecting a radioactive, thermally stable vapor phase tracer into said steam injection well, said vapor phase tracer selected from the group: radioactive Krypton, radioactive Argon, and radioactive Xenon;

(c) determining a vapor transit time in said annulus with said logging tool;

(d) moving said logging tool to a second location;

(e) repeating steps (b) and (c); and (f) calculating, by use of said transit time, an amount of vapor entering a formation between said first and said second location.

4. A method of determining steam profiles in a steam injection well having an annulus and a perforated zone above a tubing tail comprising the steps of:

(a) inserting a well logging tool into said steam injection well at a first location, said logging tool further comprising a first gamma ray detector, said first location above said tubing tail;

(b) inserting a second gamma ray detector in communication with said steam upstream of said first gamma ray detector;

(c) injecting a radioactive, thermally stable tracer into said steam injection well, said tracer selected from the group: radioactive Argon, radioactive Krypton, and radioactive Xenon;

(d) determining a transit time from the time said tracer passes said first detector until the time said tracer passes said second detector;

(e) determining a transit time from the time said tracer passes said second detector in said tubing until the time said tracer passes said second detector in said well annulus;

(f) moving said tool to a second location;

(g) repeating at least steps (c) and (e);

(h) calculating, by use of said transit time, an amount of fluid entering a formation between said first and said second location.

* * * * *